US010069214B1

(12) United States Patent
Hooper et al.

(10) Patent No.: US 10,069,214 B1
(45) Date of Patent: Sep. 4, 2018

(54) CONSTRAINED DIAMETER PHASED ARRAY ANTENNA SYSTEM AND METHODS

(71) Applicant: SPAWAR Systems Center Pacific, San Diego, CA (US)

(72) Inventors: Ralph David Hooper, Lemon Grove, CA (US); Christopher Joseph Meagher, San Diego, CA (US); Jia-Chi Chieh, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 72 days.

(21) Appl. No.: 15/253,398

(22) Filed: Aug. 31, 2016

(51) Int. Cl.
*H01Q 21/00* (2006.01)
*H01Q 21/24* (2006.01)
*H01Q 1/36* (2006.01)

(52) U.S. Cl.
CPC ..... *H01Q 21/24* (2013.01); *H01Q 1/36* (2013.01)

(58) Field of Classification Search
CPC ..... H01Q 3/2605; H01Q 15/02; H01Q 19/06; H01Q 21/0031; H01Q 25/008
See application file for complete search history.

(56) References Cited

U.S. PATENT DOCUMENTS

| | | | | |
|---|---|---|---|---|
| 4,931,803 | A | 6/1990 | Shimko | |
| 5,623,270 | A | 4/1997 | Kempkes et al. | |
| 6,295,035 | B1 | 9/2001 | Holzheimer | |
| 6,388,622 | B1 * | 5/2002 | Jennetti | H01Q 1/246 343/700 MS |
| 7,446,601 | B2 | 11/2008 | LeChevalier | |
| 7,671,687 | B2 | 3/2010 | LeChevalier | |
| 2005/0285541 | A1 | 12/2005 | LeChevalier | |
| 2009/0114839 | A1 | 5/2009 | LeChevalier | |
| 2011/0285582 | A1 * | 11/2011 | Zhang | G01S 7/024 342/26 R |

* cited by examiner

*Primary Examiner* — Graham Smith
(74) *Attorney, Agent, or Firm* — SPAWAR Systems Center Pacific; Kyle Eppele

(57) ABSTRACT

A constrained diameter phased array antenna system involving at least one dielectric superstrate, a generally cylindrical arrangement of antennas in a generally circular array, the arrangement proximate to the at least one dielectric superstrate, and at least one phase shifter coupled with the arrangement in an orientation corresponding to at least one scanning plane, whereby a communication range is increasable.

16 Claims, 6 Drawing Sheets

CONSTRAINED DIAMETER PHASED ARRAY ANTENNA SYSTEM AND METHODS

FEDERALLY-SPONSORED RESEARCH AND DEVELOPMENT

The United States Government has ownership rights in the subject matter of the present disclosure. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 102,796.

BACKGROUND OF THE INVENTION

Technical Field

The present disclosure technically relates to antenna systems and methods. Particularly, the present disclosure technically relates to phased array antenna systems and methods.

Description of Related Art

In the related art, current teleoperated vehicles, e.g., robots, traverse over various and varying terrain, which greatly affects the robot's movements, e.g., adversely affecting the robot's yaw, pitch, and roll. Further, as the size of a teleoperated vehicle decreases, the more severe this problem becomes. Although utilizing standard low-gain antennas in the related art meets the requisite field-of-view (FOV), standard low-gain antennas greatly reduce the range of the teleoperated vehicle, especially in relation to "man portable" robots. Hence, the need for a continuous FOV has necessitated the use of low-gain omnidirectional antennas. Much research has been performed in the related art for increasing the communication range of teleoperated vehicles, but such related art research has merely focused on improvements to a base station antenna, radio coding methods, and utilizing radio nodes.

In the related art, U.S. Pat. No. 4,931,803, entitled "Electronically Steered Phased Array Radar Antenna," issued on Jun. 5, 1990, discloses an electronically steered phased array antenna system. The system includes a phased array radar antenna having a microwave phased shifter for inserting a predetermined amount of path delay into each of the radiated elements of the antenna. The system also includes a beam steering controller connected to, and adapted to control, the microwave phase shifter according to predetermined parameters relating to the antenna. An electronically erasable programmable read only memory device is disposed on the antenna itself for storing the predetermined parameters relating to the antenna. The memory device is connected to the controller and, by inputting data into the memory of the controller, the controller is converted from a generic device to a dedicated controller for the given antenna. The memory device can be reprogrammed without removal from the antenna for changing the antenna configuration data.

In the related art, U.S. Pat. No. 5,623,270, entitled "Phased Array Antenna," issued on Apr. 22, 1997, discloses a phased array antenna system that compensates for the effects of antenna flexure, vibration, and movement, whereby these effects are negated by introducing an appropriate phase or time delay into the signals being radiated from, and received by, the discrete antenna elements comprising the phased array antenna. This compensation eliminates the need for massive rigid back structures to maintain antenna rigidity.

In the related art, techniques are proposed for increasing the communication range of teleoperated vehicles, but such related art research has merely focused on improvements to a base station antenna, radio coding methods, and utilizing radio nodes. Therefore, a need exists in the related art for the development of systems and methods for increasing a communication range of a teleoperated vehicle that is compatible, retrofittable, and operable in relation to the teleoperated vehicle itself.

BRIEF SUMMARY OF INVENTION

To address the needs and challenges in the related art, including, but not limited to, increasing a communication range of a teleoperated vehicle, the present disclosure involves constrained diameter phased array antenna systems and methods.

In accordance with an embodiment of the present disclosure, a constrained diameter phased array antenna system comprises at least one dielectric superstrate, a generally cylindrical arrangement of antennas in a generally circular array, the arrangement proximate to the at least one dielectric superstrate, and at least one phase shifter coupled with the arrangement in an orientation corresponding to at least one scanning plane, whereby a communication range is increasable.

BRIEF DESCRIPTION OF THE DRAWING

The above, and other, aspects and features of several embodiments of the present disclosure are further understood from the following Detailed Description as presented in conjunction with the following several figures of the Drawing.

Figure 1A:
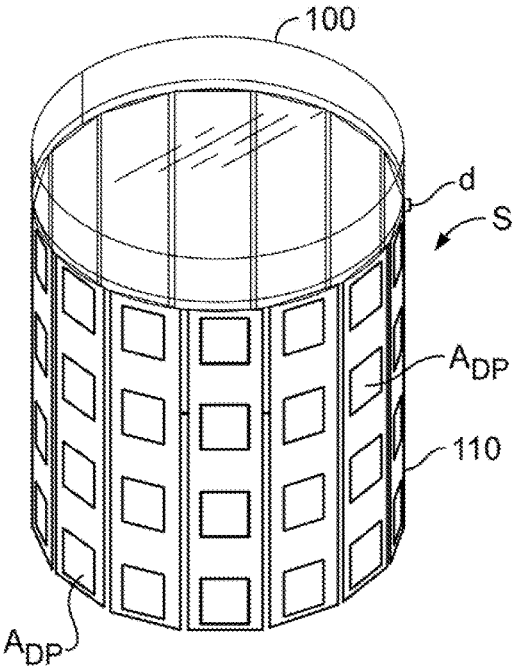
FIG. 1A is a diagram illustrating a perspective view of a constrained diameter phased array antenna system, in accordance with an embodiment of the present disclosure.

Corresponding reference numerals or characters indicate corresponding components throughout the several figures. Elements in each of the figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiment are often not depicted in order to facilitate a less obstructed view of these various embodiments of the present disclosure.

DETAILED DESCRIPTION OF THE EMBODIMENT(S)

The systems and methods of the present disclosure are also compatible, retrofittable, and operable in relation to the disclosed teleoperated vehicle itself as well as in relation to related art technologies. The constrained diameter phased array antenna systems and methods for mobile equipment of the present disclosure improve performance, and the communication range, of mobile equipment, such as robotic platforms. The systems of the present disclosure comprise at least one generally cylindrical arrangement of antennas, such as omnidirectional phased array antennas, for increasing radio frequency (RF) gain. For antennas in a simple free space scenario, increasing the RF antenna gain increases communications range or distance between a remote control station and the unit relying on the antenna.

Features of the present disclosure include, but are not limited to, utilizing a variety of antennas, hitherto unfeasible in the related art, such as a directional antenna with a pan and tilt system, an omnidirectional low gain whip antenna, an omnidirectional high-gain antenna, and the like, as well as increasing gain of the antennas, whereby roll, pitch, and yaw of the robot is readily correctable.

FIG. 1A illustrates a perspective view of a constrained diameter phased array antenna system S operable with mobile equipment (not shown), in accordance with one embodiment of the present disclosure. The constrained diameter phased array antenna system S comprises: at least one dielectric superstrate 100; a generally cylindrical arrangement of antennas 110, each of the antennas represented as $A_{DP}$, in a generally circular array, the arrangement 110 proximate to the at least one dielectric superstrate 100; and at least one phase shifter 600 coupled with the arrangement in an orientation corresponding to at least one scanning plane (see FIG. 6). Alternatively, the dielectric superstrate 100 may comprise a generally tubular or hollow shape having a thickness in a range based on a particular application of the system S, the material type(s) for the system S, the frequency, and a trade-off relating to gain as a function of beam width. The distance from each antenna $A_{DP}$ to a bottom/inner surface of the superstrate 100 is also a variable parameter that is encompassed by the present disclosure.

Figure 1B:
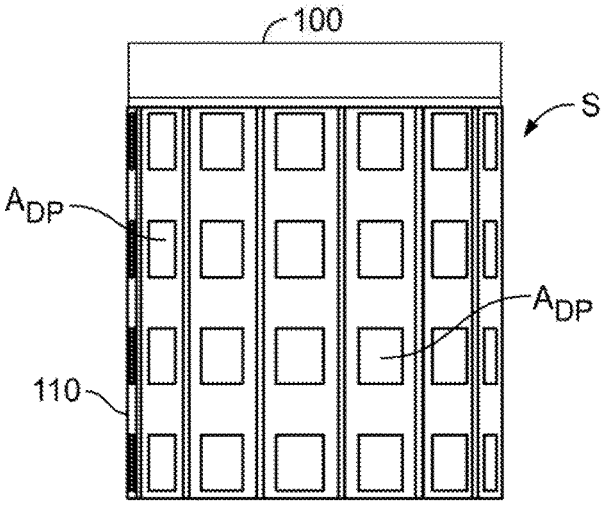
FIG. 1B is a diagram illustrating a side view of a constrained diameter phased array antenna system, in accordance with an embodiment of the present disclosure.

Referring now to FIG. 1B, a side view of a constrained diameter phased array antenna system S operable with mobile equipment (not shown), in accordance with an embodiment of the present disclosure is illustrated. The system S comprises a generally cylindrical arrangement of high-gain omnidirectional antennas, by example only, in a circular array 110, each of the antennas represented as $A_{DP}$, being cost-effective, in relation to moving equipment, such as on a mobile platform, thereby enabling tracking of the mobile equipment, e.g., a robotic vehicle, a teleoperated vehicle, and the like, by one or more base station antennas, without any adverse tracking errors arising from motion experienced by the mobile equipment, such as in terms of roll, pitch, and yaw. Hence, a greater RF antenna-gain is attained.

Figure 1C:
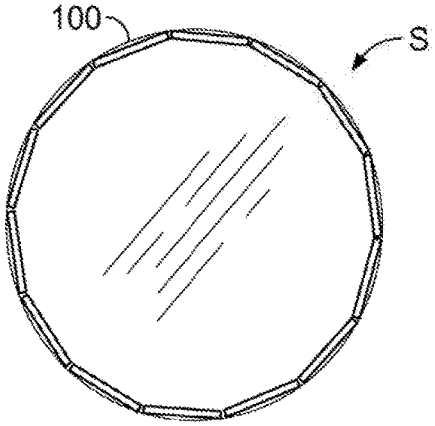
FIG. 1C is a diagram illustrating a top view of a constrained diameter phased array antenna system, in accordance with an embodiment of the present disclosure.

FIG. 1C is a diagram illustrating a top view of a constrained diameter phased array antenna system S operable with mobile equipment (not shown), in accordance with an embodiment of the present disclosure. The at least one dielectric superstrate 100 comprises a generally disk shape and a diameter approximating that of the generally cylindrical arrangement of high-gain omnidirectional antennas in a circular array 110 (as shown in FIG. 1A-B). The diameter of the at least one dielectric superstrate 100 may vary as a function of that of the generally cylindrical arrangement of high-gain omnidirectional antennas in a circular array 110 (as shown in FIG. 1A-B). The generally cylindrical arrangement of high-gain omnidirectional antennas in a circular array 110 (as shown in FIG. 1A-B) has a diameter approximately equal to that of the at least one dielectric superstrate 100 plus lambda, where $\lambda$ is equal to a given wavelength, such as a wavelength of the transmitted signal. The wavelength of the transmitted signal may be determinable as approximately 1/f, wherein f=the frequency of the transmitted signal. The generally cylindrical arrangement of high-gain omnidirectional antennas in a circular array 110 (as shown in FIG. 1A-B) may be printed on a circuit board. The dielectric superstrate 100 and the generally cylindrical arrangement of high-gain omnidirectional antennas in a circular array 110 (as shown in FIG. 1A-B) are spaced apart by a distance d that is approximately one half the value of lamda ($\lambda/2$). It is noted that the distance d may be adjustable and optimizable in relation to a gain setting for a given antenna.

Still referring to FIG. 1C, the at least one dielectric superstrate 100 comprises at least one of the following materials: a material having a dielectric constant greater than one, a magneto-dielectric material, a meta-magneto-dielectric material, such as a magneto-dielectric material having at least one metallic patch, a magneto-dielectric material having at least one metallic print, a magneto-dielectric material having a periodic metallic print, a ceramic thermoset polymer composite material, an FR-4 dielectric material or any circuit board material, such as a printed circuit board laminate material, and the like, by example only.

Figure 2:
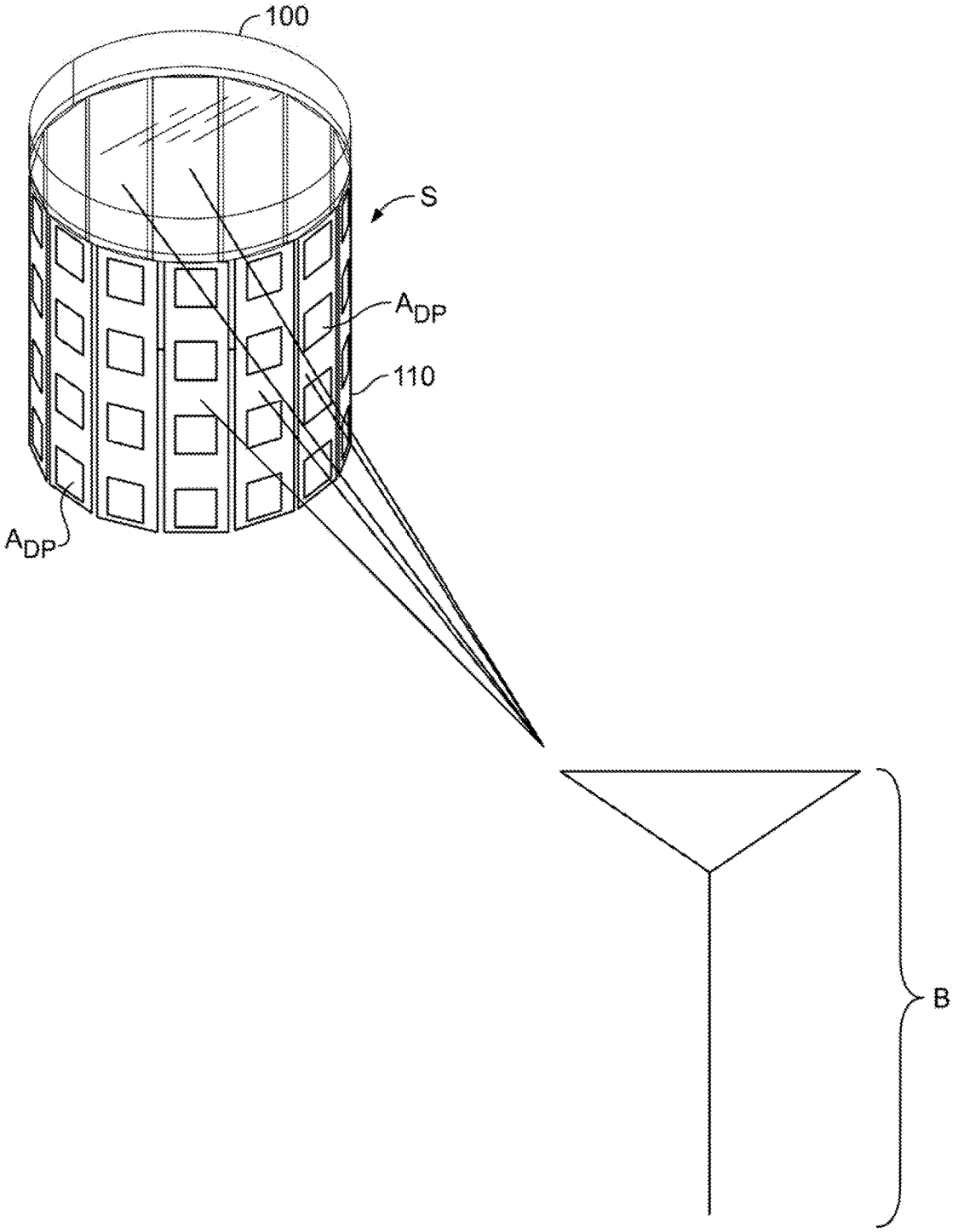
FIG. 2 is a diagram illustrating a constrained diameter phased array antenna system, the system comprising a generally cylindrical arrangement of antennas in a circular array proximate at least one dielectric superstrate, in accordance with an embodiment of the present disclosure.

FIG. 2 illustrates a constrained diameter phased array antenna system S operable with mobile equipment (not shown), the system S comprising a generally cylindrical arrangement of high-gain omnidirectional antennas, by example only, in a circular array 110 proximate the at least one dielectric superstrate 100, in accordance with an embodiment of the present disclosure. The system S is configured to combine a plurality of transmitted signals from a plurality of high-gain omnidirectional antennas and to transmit the plurality of feeds to a base station antenna B, whereby gain of the system S is increasable, and whereby steering the system S in at least one parameter of pitch and roll is facilitated.

Figure 3:
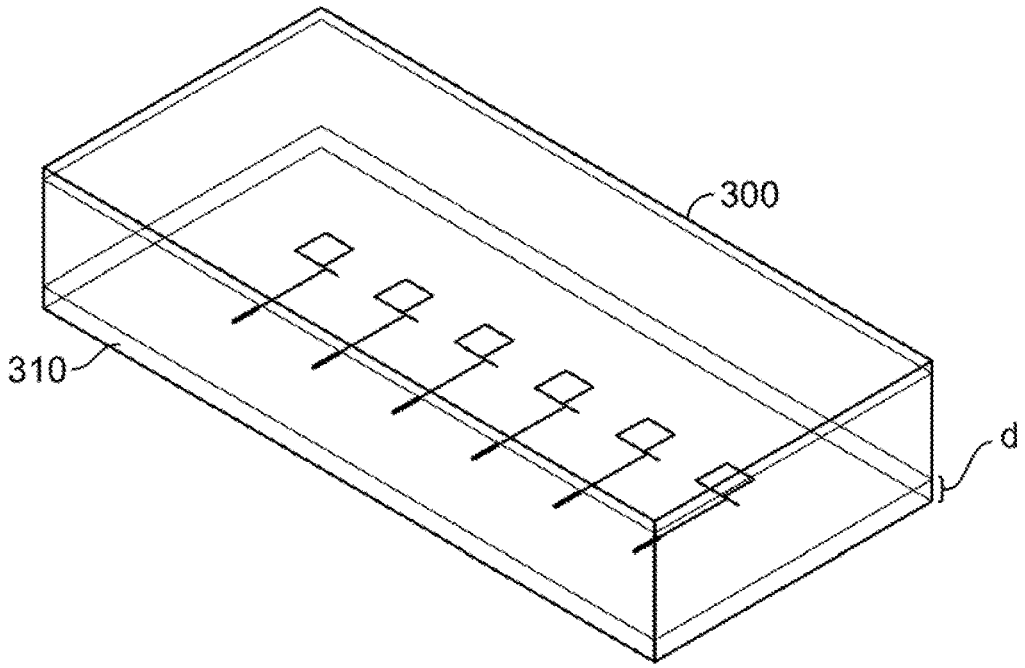
FIG. 3 is a diagram illustrating a plurality of antennas in a linear array proximate a dielectric superstrate, whereby the linear array has a higher gain and narrower beam width, in accordance with an embodiment of the present disclosure.

FIG. 3 illustrates a plurality of antennas in a linear array 310 having a proximate a dielectric superstrate 300 FIG. 3 illustrates the general principle of operation which is encompassed by the embodiments of the present disclosure. The dielectric superstrate 300 comprises a superstrate lens. The dielectric superstrate 300 is composed of a dielectric material with a thickness less than approximately λ/4. The dielectric superstrate 300 and the plurality of antennas in a linear array 310 are spaced apart by a distance d that is approximately λ/2. Alternatively, the distance d may be adjustable and optimizable in relation to a gain setting for a given antenna.

Still referring to FIG. 3 and back to FIGS. 1A-2, a circular array is configurable as a plurality of "sectors," wherein each sector comprises an effective planar or two-dimensional (2-D), antenna array, e.g., having an x-axis and a y-axis, being configured with a curvature. For example, the circular array of FIGS. 1A, 1B and 2 comprise four (4) sectors, wherein each sector of the four sectors covers a 90° FOV. Each sector is concurrently operable in relation to another sector, and a sector is configured to scan a beam within its corresponding FOV. Alternatively, one or more of the sectors may overlap another sector, wherein an angular resolution of a scanned beam is a function of a beam width for an antenna type used and of a number of a bit resolution for a phase shifter used.

Still referring to FIG. 3 and back to FIGS. 1A-2, since an antenna functions as a spatial filter, an angle exists at which the gain is at a maximum. By scanning a beam within a prescribed FOV, the maximum gain is available for all angles within a FOV corresponding to one sector. Since the circular array of the present disclosure comprises a plurality of sectors, a maximum gain is available for all azimuth angles. An additional feature of the embodiments in the present disclosure involves at least one dielectric superstrate, e.g., referred to as a "lens," to increase the gain and to narrow the beam width of the sector having a corresponding antenna array, without significantly increasing the surface area of the corresponding antenna array.

Figure 4:
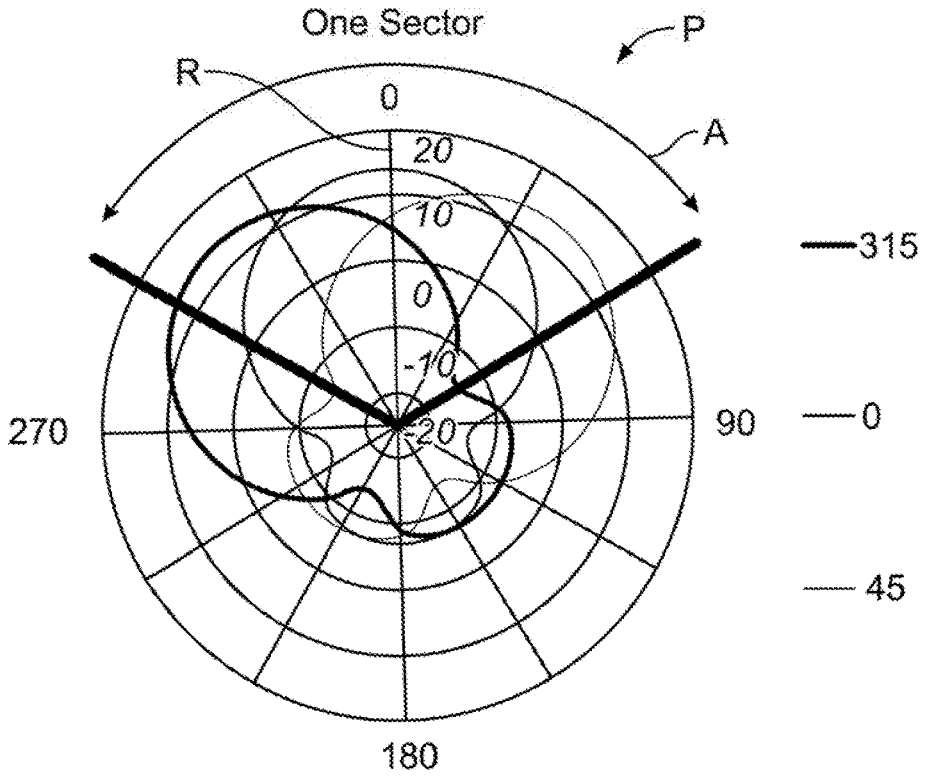
FIG. 4 is a diagram illustrating an azimuth radiation pattern corresponding to one array of one, by example only, such as included in a constrained diameter phased array antenna system, wherein a sector represents an angular direction of radiation in degrees, and wherein a radial axis represents gain in dBi, in accordance with an embodiment of the present disclosure.

FIG. 4 illustrates an example of an azimuth radiation pattern P corresponding to one array of one sector wherein a sector A represents an angular direction of radiation in degrees, and wherein a radial axis R represents gain in dBi, in accordance with an embodiment of the present disclosure. The FOV is set, wherein each sector overlaps another sector, thereby providing full angular coverage. Within each sector, an antenna radiation pattern is steerable away from a broadside. The minimum beam steering step is dictated by a bit resolution of a phase shifter (not shown). As more antenna elements are used, the gain of the sector antenna array increases, thereby increasing the overall area and size of the array. A sector antenna array is configured to achieve a nominal gain of approximately +12 dBi, whereby received power is increasable by approximately 15 times in relation to that of an omnidirectional antenna. The antenna patterns, such as pattern P, are based on a 4×1 elevation plane array at approximately 5 GHz with λ/2 inter-elemental spacing, wherein λ=wavelength.

Figure 5:
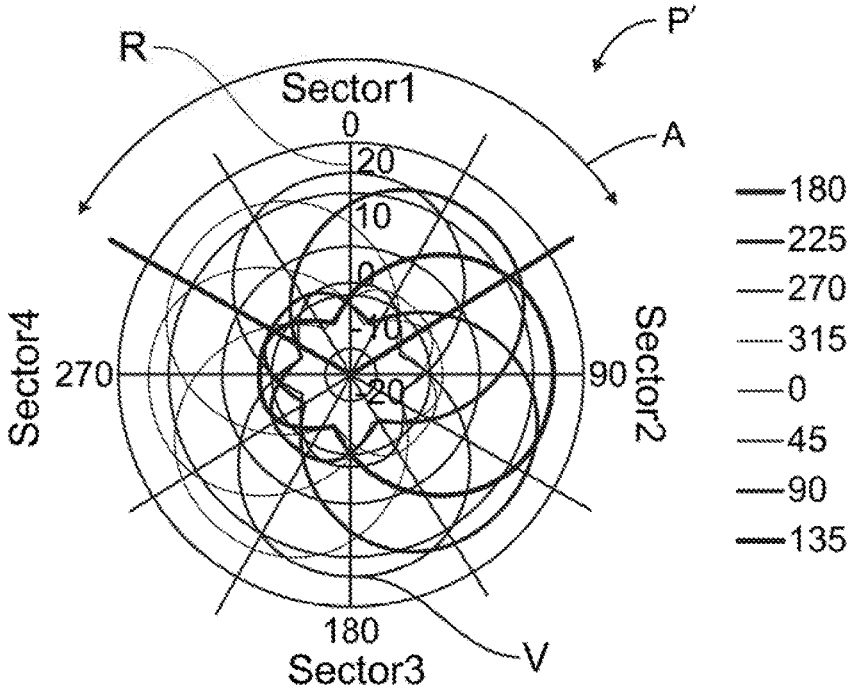
FIG. 5 is a diagram illustrating an azimuth radiation pattern corresponding to four array sectors, by example only, such as included in a constrained diameter phased array antenna system, wherein a sector represents an angular direction of radiation in degrees, and wherein a radial axis represents gain in dBi, in accordance with an embodiment of the present disclosure.

FIG. 5 illustrates an example azimuth radiation pattern P' corresponding to four arrays corresponding to four sectors By using four sectors, each sector comprising a corresponding antenna array, full 360° azimuth coverage is achievable. In this configuration, however, greater gain is achieved than by using merely a single omnidirectional antenna. The antenna patterns, such as pattern P', are based on a 4×1 elevation plane array at approximately 5 GHz with λ/2 inter-elemental spacing, wherein λ=wavelength.

Figure 6:
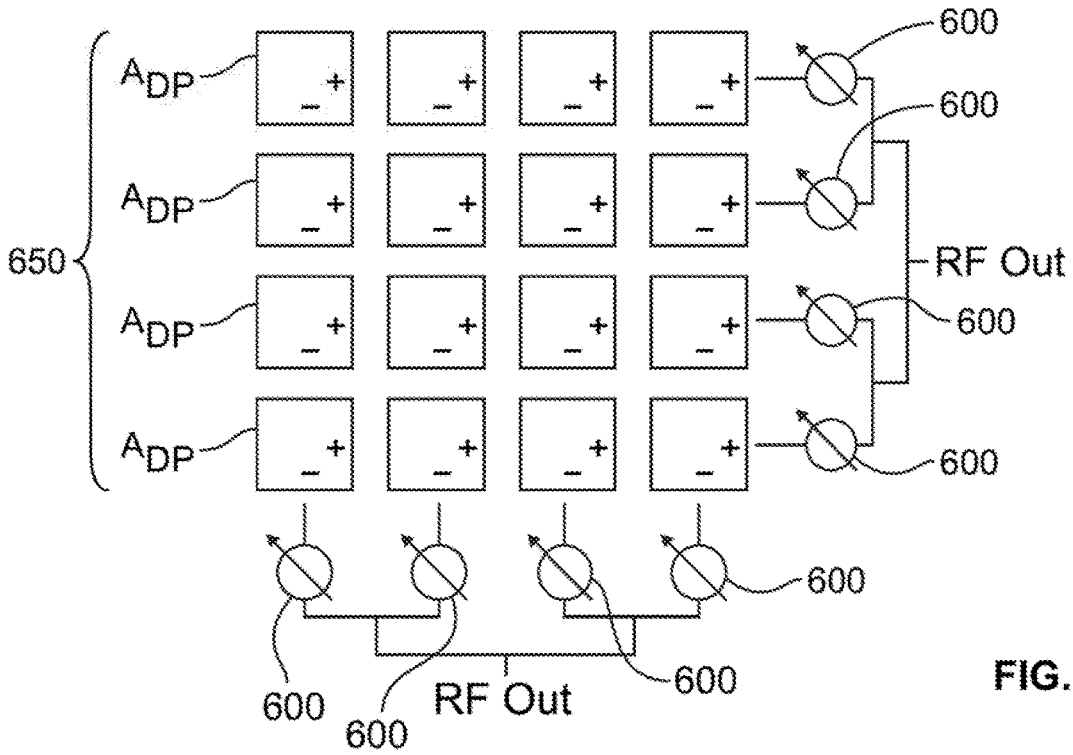
FIG. 6 is a diagram illustrating a phased array in an elevational and an azimuth plane using dual polarized antennas, such as included in a constrained diameter phased array antenna system, wherein the "–" and "+" symbols denote respective orthogonal polarizations, in accordance with an embodiment of the present disclosure.

FIG. 6 illustrates an example of a phased array 650 in an elevation and an azimuth plane using at least one dual polarized antenna $A_{DP}$, such as included in a constrained diameter phased array antenna system, wherein the "–" and "+" symbols denote respective orthogonal polarizations, in accordance with an embodiment of the present disclosure. Coverage, comprising scanning in an elevation plane, is achievable by disposing a plurality of phase shifters 600 in the vertical array configuration. To ease the differentiation between array signal feeds in the vertical orientation (elevation plane) and the horizontal orientation (azimuth plane), the system comprises at least one dual polarized antenna $A_{DP}$. In this manner, the plurality of phase shifters 600 are coupled with the phased array 650 in each orientation to achieve scanning in both planes.

Referring back to FIGS. 1A-6, the system S further is responsive to a set of executable instructions storable in relation to a non-transitory memory device, and comprises a plurality of sensors configured to quickly determine a signal strength in relation to a beam direction, either by communicating via a radio frequency or by directly measuring the received signal strength indication (RSSI) value. The set of executable instructions comprises a modification to software, such as described in relation to the parent application of this document, wherein the software source code may be captured in a "C" language and configured to run on various operating systems, including but not limited to Linux and POSIX-compliant versions of UNIX.

The set of executable instructions may be comprised of two principal sets of executable instructions. The first principal set of instructions may be a set of searching instructions for (a) detecting a link from a target, such as an unmanned ground vehicle (UGV), by sweeping through a plurality of antenna beams and (b) upon detecting the link from the target, switching the antenna system to a tracking mode by commencing tracking the target. Furthermore, the set of searching instructions may comprise using at least one parameter, such as a dwell time, the dwell time being determined as a period of time that each beam waits for an uplink condition.

The second principal set of instructions may comprise a set of tracking instructions for (a) tracking the target by sweeping through all beam directions, (b) taking an RSSI measurement at each beam direction, and (c) selecting the beam direction having the highest RSSI measurement. The set of tracking instructions comprises using at least one parameter, such as a cycle time, a dwell time, or an acceptable RSSI value. Cycle time is the frequency at which one sweeps through the beam directions. A faster cycle time is more appropriate for dynamic environments, whereas a slower cycle time may be better suited for more benign RF environments However, in a rapidly changing RF environment, the step of checking non-ideal beams is required to track the target. An appropriate balance must be determined to optimize both communications and tracking. The dwell time and acceptable RSSI value are both determined by the communication system that is utilized.

A modification to the software may comprise an instruction for, not only checking base beam directions in a plan view, but also an instruction for checking a vertical orientation. Further, the system S is operable with any mobile communications application, with a relatively slowly moving or fixed base station antenna and a moving receiver, requiring greater RF range for maintaining communication with a network, including, but not limited to, teleoperated robots, teleinstructed animals, teleoperated physical security robots, e.g., while transiting routes over areas where maintaining communications may be challenging.

Figure 7:
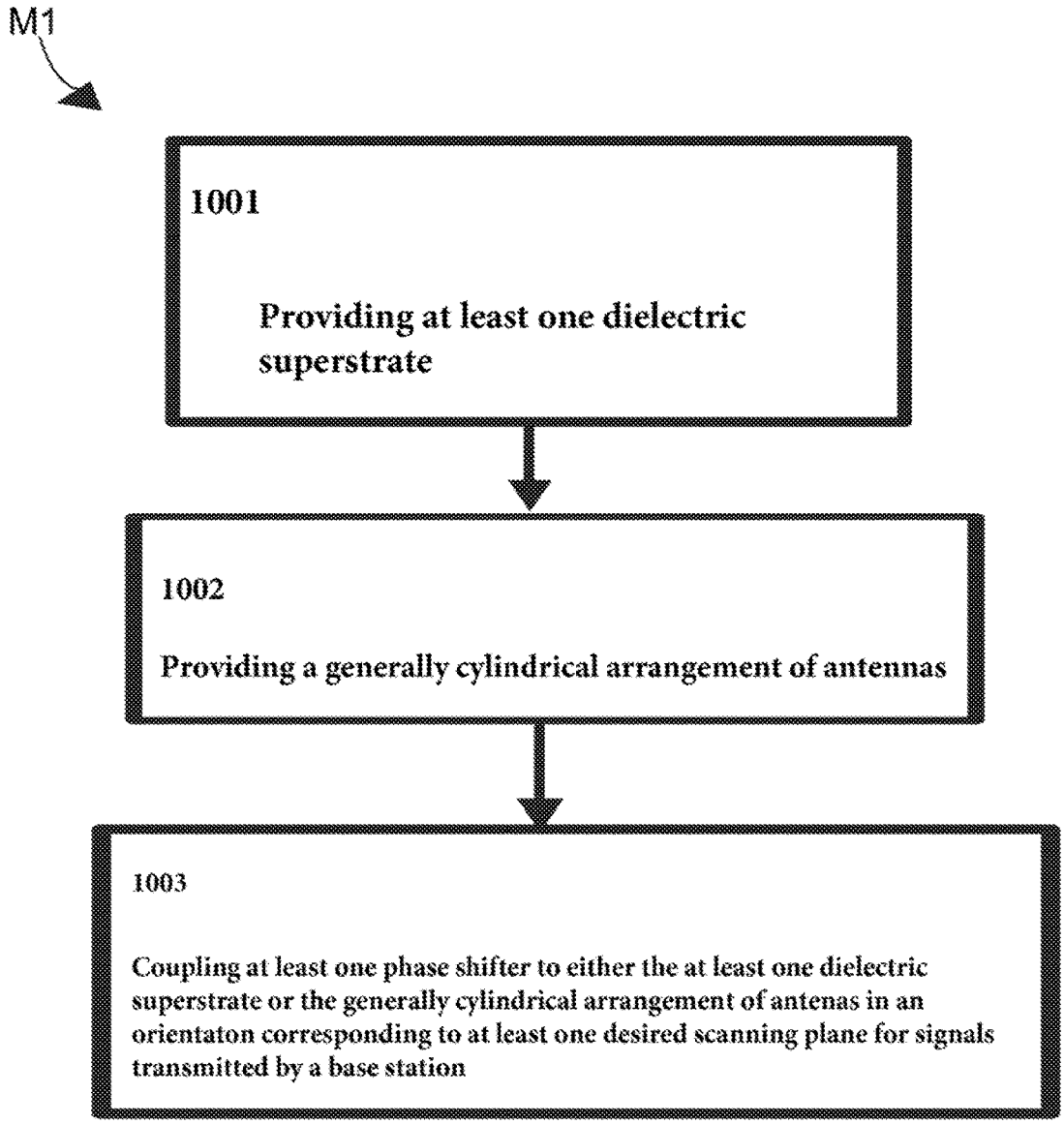
FIG. 7 is a diagram illustrating a method of fabricating a constrained diameter phased array antenna system, in accordance with an embodiment of the present disclosure.

Referring to FIG. 7, this flow diagram illustrates a method M1 of fabricating a constrained diameter phased array antenna system S, in accordance with an embodiment of the present disclosure. The method M1 comprises the steps of: providing at least one dielectric superstrate 100, as indicated by block 1001; providing a generally cylindrical arrangement of antennas in a generally circular array 110, each of the antennas represented as $A_{DP}$, providing the arrangement 110 comprising disposing the arrangement 110 proximate to the at least one dielectric superstrate 100, as indicated by block 1002; and coupling at least one phase shifter 600 with the arrangement 100 in an orientation corresponding to at least one scanning plane, as indicated by block 1003, whereby a communication range is increasable.

Still referring to FIG. 7, in the method M1, providing the generally cylindrical arrangement of antennas 110 each of the antennas represented as $A_{DP}$, comprises providing at least one high-gain omnidirectional antenna, providing the generally cylindrical arrangement of antennas 110 comprises providing at least one dual polarized antenna, providing the at least one phase shifter 600 comprises orienting the at least one phase shifter 600 in a vertical orientation, providing the at least one phase shifter 600 comprises orienting the at least one phase shifter 600 in a horizontal orientation, providing the at least one phase shifter 600 comprises orienting the at least one phase shifter 600 in at least one scanning plane of an elevation plane and an azimuth plane, providing the at least one dielectric superstrate 100 comprises providing the at least one dielectric superstrate 100 with a generally disk shape and a diameter approximating that of the generally cylindrical arrangement 110, providing the at least one dielectric superstrate 100 comprises providing at least one material of a magneto-dielectric material having at least one metallic patch, a magneto-dielectric material having at least one metallic print, a magneto-dielectric material having a periodic metallic print, a ceramic thermoset polymer composite material, an FR-4 dielectric material, a Duroid® dielectric material, Rogers® R04003 dielectric material, Rogers® R04350 dielectric material, a Rogers® TMM10 dielectric material, any circuit board material, such as a printed circuit board laminate material, and the like, and providing the arrangement 110 comprises providing a plurality of sectors, providing the plurality of sectors comprises providing each sector with a corresponding antenna array, whereby full azimuth coverage is achievable, and whereby gain is increasable.

Figure 8:
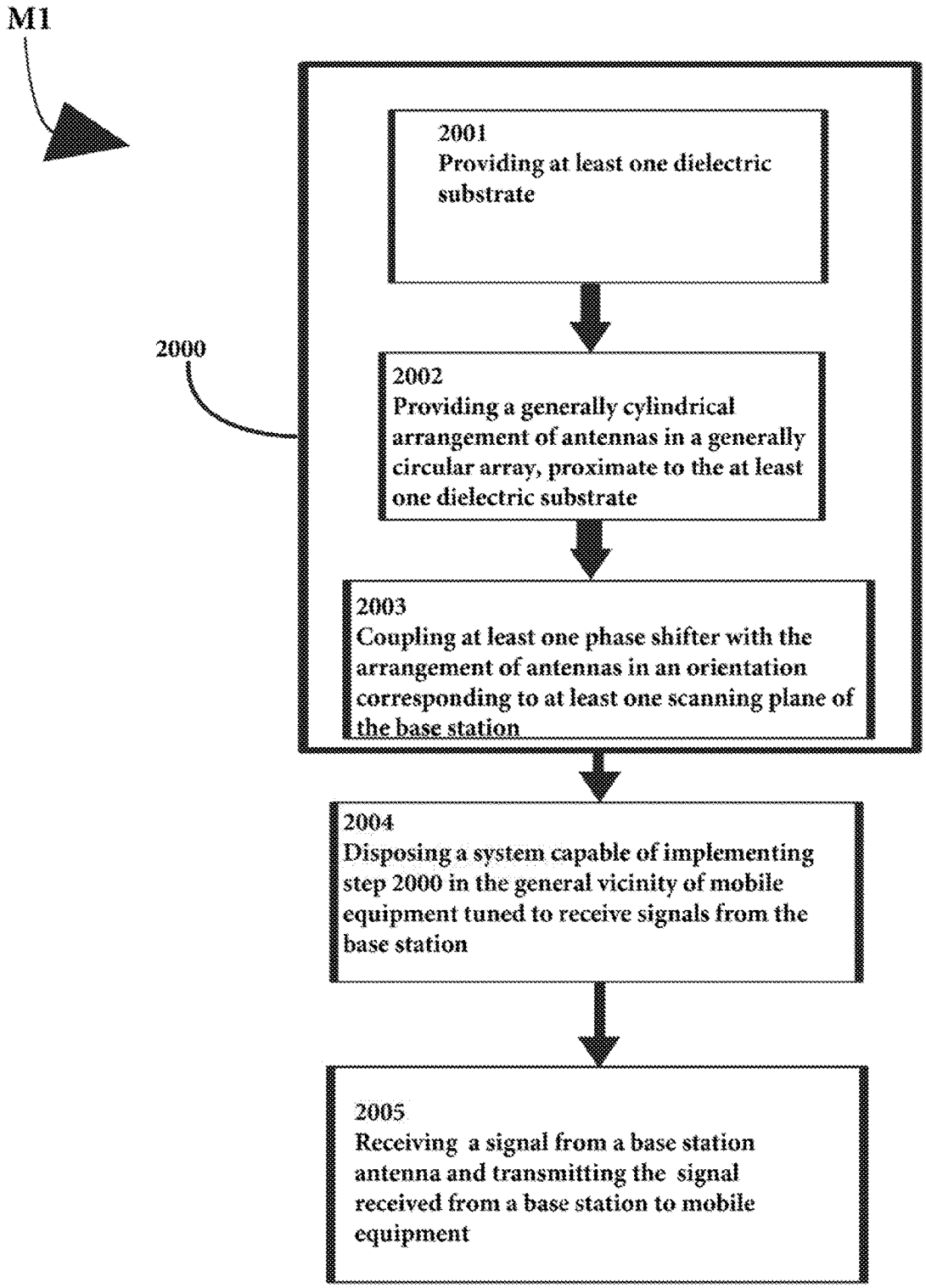
FIG. 8 is a diagram illustrating a method of increasing communication range, e.g., of mobile equipment by way of a constrained diameter phased array antenna system, in accordance with an embodiment of the present disclosure.

FIG. 8, is a flow diagram illustrating a method M2 of increasing communication range by way of a constrained diameter phased array antenna system S, comprising: providing a constrained diameter phased array antenna system S, as indicated by block 2000, providing the system S comprising: providing at least one dielectric superstrate 100, as indicated by block 2001; providing a generally cylindrical arrangement of antennas in a generally circular array 110, each of the antennas represented as $A_{DP}$, providing the arrangement 110 comprising disposing the arrangement 110 proximate to the at least one dielectric superstrate 100, as indicated by block 2002; and coupling at least one phase shifter 600 with the arrangement 110 in an orientation corresponding to at least one scanning plane, as indicated by block 2003, whereby a communication range is increasable; disposing the system S in relation to mobile equipment, as indicated by block 2004; and performing at least one of transmitting a signal from a base station antenna B and receiving a signal from the base station antenna B, as indicated by block 2005, thereby increasing communication range, e.g., of the mobile equipment.

Still referring to FIG. 8, the method M2 further comprises executing a set of instructions storable in relation to a non-transitory memory device (not shown), and comprises a plurality of sensors (not shown) configured to quickly determine a signal strength in relation to a beam direction, either by communicating via a radio frequency or by directly measuring the received signal strength indication (RSSI) value. For example, reasonably assuming that a base station antenna B does not move rapidly relative to a robotic vehicle, the plurality of sensors receive input relating to changes in the vehicle's disposition, wherein a new vehicle disposition is estimable, and wherein data corresponding to the changes are processed by a controller operable by the set of executable instructions.

It is understood that many additional changes in the details, materials, substances, species, steps and arrangement of parts, which have been herein described and illustrated to explain the nature of the present disclosure, may be made within the principle and scope of the present disclosure as expressed in the appended claims.

What is claimed:

1. A constrained diameter phased array antenna system, comprising:

at least one tubular shaped dielectric superstrate, each tubular shaped dielectric superstrate having approximately the same diameter;

a generally circular array of antennas, the diameter of the circular array being less than the diameter of the at least one tubular shaped dielectric superstrate and being disposed proximate to the at least one tubular shaped dielectric superstrate, wherein the generally circular array comprises a plurality of sectors, each sector comprising a corresponding antenna array, whereby the generally circular array is configured to achieve full azimuth coverage; and at least one phase shifter coupled to the generally circular array in an orientation corresponding to at least one scanning plane, and wherein the at least one dielectric superstrate comprises a superstrate lens configured to increase antenna gain and narrow beam width of a sector in the plurality of sectors without significantly increasing the surface area of the corresponding antenna array.

2. The system of claim 1, wherein the generally cylindrical arrangement of antennas comprises at least one high-gain omnidirectional antenna.

3. The system of claim 1, wherein the generally cylindrical arrangement of antennas comprises at least one dual polarized antenna.

4. The system of claim 1, wherein the at least one phase shifter is oriented in a vertical orientation relative to the axis of the circular array.

5. The system of claim 1, wherein the at least one phase shifter is oriented in a horizontal orientation relative to the axis of the circular array.

6. The system of claim 1, wherein the at least one scanning plane comprises at least one of an elevation plane and an azimuth plane.

7. The system of claim 1, wherein the at least one tubular shaped dielectric superstrate comprises at least one material of a magneto-dielectric material having at least one metallic patch, a magneto-dielectric material having at least one metallic print, a magneto-dielectric material having a periodic metallic print, a ceramic thermoset polymer composite material, an FR-4 dielectric material, a Duroid® dielectric material, Rogers® R04003 dielectric material, Rogers® R04350 dielectric material, a Rogers® TMM10 dielectric material, or any circuit board material.

8. The system of claim 1, further comprising:

a controller operable by way of a set of executable instructions storable in relation to a non-transitory memory device, and a plurality of sensors configured to determine a detected signal strength in relation to a beam direction.

9. A method of fabricating a constrained diameter phased array antenna system, the method comprising:

providing at least one tubular shaped dielectric superstrate, each tubular shaped dielectric superstrate having approximately the same diameter;

providing a generally circular array of antennas, the diameter of the circular array being less than the diameter of the at least one tubular shaped dielectric superstrate, wherein the generally circular array is disposed proximate to the at least one tubular shaped dielectric superstrate, and wherein the generally circular array comprises a plurality of sectors, each sector comprising a corresponding antenna array, whereby the generally circular array is configured to achieve full azimuth coverage; and coupling at least one phase shifter to the generally circular array in an orientation corresponding to at least one scanning plane, and wherein the at least one dielectric superstrate comprises a superstrate lens configured to increase antenna gain and narrow beam width of a sector in the plurality of sectors without significantly increasing the surface area of the corresponding antenna array.

10. The method of claim 8, wherein providing the generally cylindrical arrangement of antennas comprises providing at least one high-gain omnidirectional antenna.

11. The method of claim 9, wherein providing the generally cylindrical arrangement of antennas comprises providing at least one dual polarized antenna.

12. The method of claim 9, wherein providing the at least one phase shifter comprises orienting the at least one phase shifter in a vertical orientation relative to the at least one tubular shaped superstrate.

13. The method of claim 9, wherein providing the at least one phase shifter comprises orienting the at least one phase shifter in a horizontal orientation relative to the at least one tubular shaped superstrate.

14. The method of claim 9, wherein providing the at least one phase shifter comprises orienting the at least one phase shifter in at least one scanning plane of an elevation plane and an azimuth plane.

15. The method of claim 9, wherein providing the at least one dielectric superstrate comprises providing the at least one tubular shaped dielectric superstrate with a generally disk shape and a diameter approximating that of the generally cylindrical arrangement, and wherein providing the at least one tubular shaped dielectric superstrate comprises providing at least one material of a magneto-dielectric material having at least one metallic patch, a magneto-dielectric material having at least one metallic print, a magneto-dielectric material having a periodic metallic print, a ceramic thermoset polymer composite material, an FR-4 dielectric material, a Duroid® dielectric material, Rogers® R04003 dielectric material, Rogers® R04350 dielectric material, a Rogers® TMM10 dielectric material, and any circuit board material.

16. The method of claim 9, further comprising:

a controller operable by way of a set of executable instructions storable in relation to a non-transitory memory device, and plurality of sensors configured to determine a signal strength in relation to a beam direction.

* * * * *